US006729234B2

(12) United States Patent
Shih

(10) Patent No.: US 6,729,234 B2
(45) Date of Patent: May 4, 2004

(54) ACTUATION SYSTEM IN AN IMAGING SYSTEM

(75) Inventor: Richard T. Shih, Andover, MA (US)

(73) Assignee: Agfa Corporation, Wilmington, DE (US)

( * ) Notice: Subject to any disclaimer, the term of this patent is extended or adjusted under 35 U.S.C. 154(b) by 2 days.

(21) Appl. No.: 10/116,905

(22) Filed: Apr. 5, 2002

(65) Prior Publication Data

US 2003/0188654 A1 Oct. 9, 2003

(51) Int. Cl.[7] ..... B41F 27/02

(52) U.S. Cl. ..... 101/389.1; 101/415.1; 101/477

(58) Field of Search ..... 101/477, 401.1, 101/415.1, 463.1, 389.1

(56) References Cited

U.S. PATENT DOCUMENTS

| | | | | | |
|---|---|---|---|---|---|
| 3,757,691 | A | * | 9/1973 | Etchell et al. | 101/415.1 |
| 4,191,106 | A | | 3/1980 | Fermi et al. | 101/415.1 |
| 4,558,615 | A | | 12/1985 | Kuehfuss | 83/74 |
| 4,569,286 | A | | 2/1986 | Bleckmann et al. | 101/382 |
| 4,653,399 | A | | 3/1987 | Kuehfuss | 101/426 |
| 4,743,324 | A | | 5/1988 | Boyce et al. | 156/215 |
| 4,748,911 | A | | 6/1988 | Kobler | 101/378 |
| 4,850,102 | A | | 7/1989 | Hironaka et al. | 29/787 |
| 4,900,008 | A | | 2/1990 | Fichter et al. | 271/277 |
| 4,936,175 | A | | 6/1990 | Clark | 83/467.1 |
| 5,009,509 | A | | 4/1991 | Matoushek et al. | 346/138 |
| 5,127,322 | A | | 7/1992 | Kobler | 101/219 |
| 5,317,971 | A | | 6/1994 | Deye, Jr. et al. | 101/486 |
| 5,331,893 | A | | 7/1994 | Wieland | 101/486 |
| 5,377,590 | A | | 1/1995 | Bolza-Schünemann et al. | 101/389.1 |
| 5,406,888 | A | * | 4/1995 | Sugiyama et al. | 101/415.1 |
| 5,497,703 | A | | 3/1996 | Becker | 101/415.1 |
| 5,540,151 | A | * | 7/1996 | Ruckmann et al. | 101/477 |
| 5,564,337 | A | | 10/1996 | Uehara et al. | 101/408 |
| 5,584,242 | A | | 12/1996 | Fuller et al. | 101/415.1 |
| 5,685,226 | A | | 11/1997 | Fuller | 101/415.1 |
| 5,764,268 | A | | 6/1998 | Bills et al. | 347/213 |
| 5,806,431 | A | | 9/1998 | Muth | 101/486 |
| 5,828,399 | A | | 10/1998 | Van Aken et al. | 347/153 |
| 5,913,267 | A | | 6/1999 | Britsch | 101/401.1 |
| 6,041,710 | A | | 3/2000 | Yasuhara | 101/415 |
| 6,053,105 | A | | 4/2000 | Rudzewitz | 101/477 |
| 6,074,112 | A | | 6/2000 | Desie et al. | 400/118.3 |
| 6,085,657 | A | | 7/2000 | Rombult et al. | 101/471 |
| 6,097,418 | A | | 8/2000 | Larsen et al. | 347/235 |
| 6,133,936 | A | | 10/2000 | Blake et al. | 347/262 |
| 6,164,204 | A | * | 12/2000 | Kawada et al. | 101/415.1 |
| 6,174,095 | B1 | | 1/2001 | Desie et al. | 400/118.3 |
| 6,184,520 | B1 | | 2/2001 | Manning et al. | 250/234 |
| 6,189,452 | B1 | * | 2/2001 | Halup et al. | 101/415.1 |
| 6,213,020 | B1 | | 4/2001 | Kawada et al. | 101/486 |
| 6,220,589 | B1 | | 4/2001 | Smith, III et al. | 269/156 |
| 6,233,038 | B1 | | 5/2001 | Lennhoff et al. | 355/47 |
| 6,237,491 | B1 | | 5/2001 | Yasuhara et al. | 101/415.1 |
| 6,238,113 | B1 | | 5/2001 | Dodge | 400/613 |
| 6,239,882 | B1 | | 5/2001 | De Mangelaere et al. | 358/474 |
| 6,250,221 | B1 | | 6/2001 | Tice | 101/246 |
| 6,260,482 | B1 | | 7/2001 | Halup et al. | 101/477 |

(List continued on next page.)

*Primary Examiner*—Daniel J. Collila
*Assistant Examiner*—Jill E. Culler
(74) *Attorney, Agent, or Firm*—Grant Houston; Robert A. Sabourin

(57) ABSTRACT

In one embodiment, an imaging system and method for operating same are provided which includes a media support surface for supporting a printing plate during recording of an image thereon, a leading edge clamping mechanism for securing a leading edge of the printing plate to the media support surface, and a trailing edge clamping mechanism for securing a trailing edge of the printing plate to the media support surface. An actuation system is used to actuate both the leading edge clamping mechanism and the trailing edge clamping mechanism.

19 Claims, 10 Drawing Sheets

U.S. PATENT DOCUMENTS 6,268,905 B1 7/2001 Schindler ..... 355/64
6,271,871 B1 8/2001 Rombult et al. ..... 347/171
6,295,929 B1 10/2001 Tice et al. ..... 101/477
6,299,045 B1 10/2001 Hebert et al. ..... 226/90
6,318,262 B1 11/2001 Wolber et al. ..... 101/401.1
6,321,651 B1 11/2001 Tice et al. ..... 101/248
6,457,410 B1 * 10/2002 Zerillo ..... 101/389.1

* cited by examiner

ACTUATION SYSTEM IN AN IMAGING SYSTEM

BACKGROUND OF THE INVENTION

In external drum image recording devices, a movable optical carriage is used to displace an image exposing or recording source in a slow scan direction while a cylindrical drum supporting recording material on an external surface thereof is rotated with respect to the image exposing source. The drum rotation causes the recording material to advance past the exposing source along a direction which is substantially perpendicular to the slow scan direction. The recording material is therefore advanced past the exposing source by the rotating drum in a fast scan direction.

An image exposing source may include an optical system for scanning one or more exposing or recording beams. Each recording beam may be separately modulated according to a digital information signal representing data corresponding to the image to be recorded.

The recording media to be imaged by an external drum imaging system is commonly supplied in discrete sheets and may comprise a plurality of plates, hereinafter collectively referred to as "plates" or "printing plates." Each plate may comprise one or more layers supported by a support substrate, which for many printing plates is a plano-graphic aluminum sheet. Other layers may include one or more image recording (i.e., "imageable") layers such as a photosensitive, radiation sensitive, or thermally sensitive layer, or other chemically or physically alterable layers. Printing plates which are supported by a polyester support are also known and can be used in the present invention. Printing plates are available in a wide variety of sizes, typically ranging, e.g., from 9"×12", or smaller, to 58"×80", or larger. The printing plate may additionally comprise a flexographic printing plate.

External drum imaging systems have been proposed in commonly assigned U.S. Pat. Nos. 6,295,929, filed May 17, 2000; 6,318,262, filed May 17, 2000; and 6,321,651, filed May 15, 2000, the entire teachings of each reference being incorporated herein by reference. In one embodiment, with reference to FIGS. 1 and 6 of the present application, an imaging system 10 is used to record rasterized digital files onto a printing plate 18 secured to a cylindrical support surface 22. A leading edge clamping mechanism 40, actuated by an actuation system 75, is used to secure the leading edge 38 of the printing plate 18 to the surface 22. A separate actuation system 100 is used to actuate a trailing edge clamping mechanism 44 to secure the trailing edge 42 to the support surface 22.

SUMMARY OF THE INVENTION

It is proposed herein to combine actuation systems 75 and 100 into a single actuation system for beneficial reasons, such as reducing system cost and providing extra room within the imaging system.

In one embodiment, an imaging system and method for operating same are provided which includes a media support surface for supporting a printing plate during recording of an image thereon, a leading edge clamping mechanism for securing a leading edge of the printing plate to the media support surface, and a trailing edge clamping mechanism for securing a trailing edge of the printing plate to the media support surface. A single actuation system is used to actuate both the leading edge clamping mechanism and the trailing edge clamping mechanism to secure or unsecure the leading edge or the trailing edge of the printing plate.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of various embodiments of the invention follows.

Figure 1:
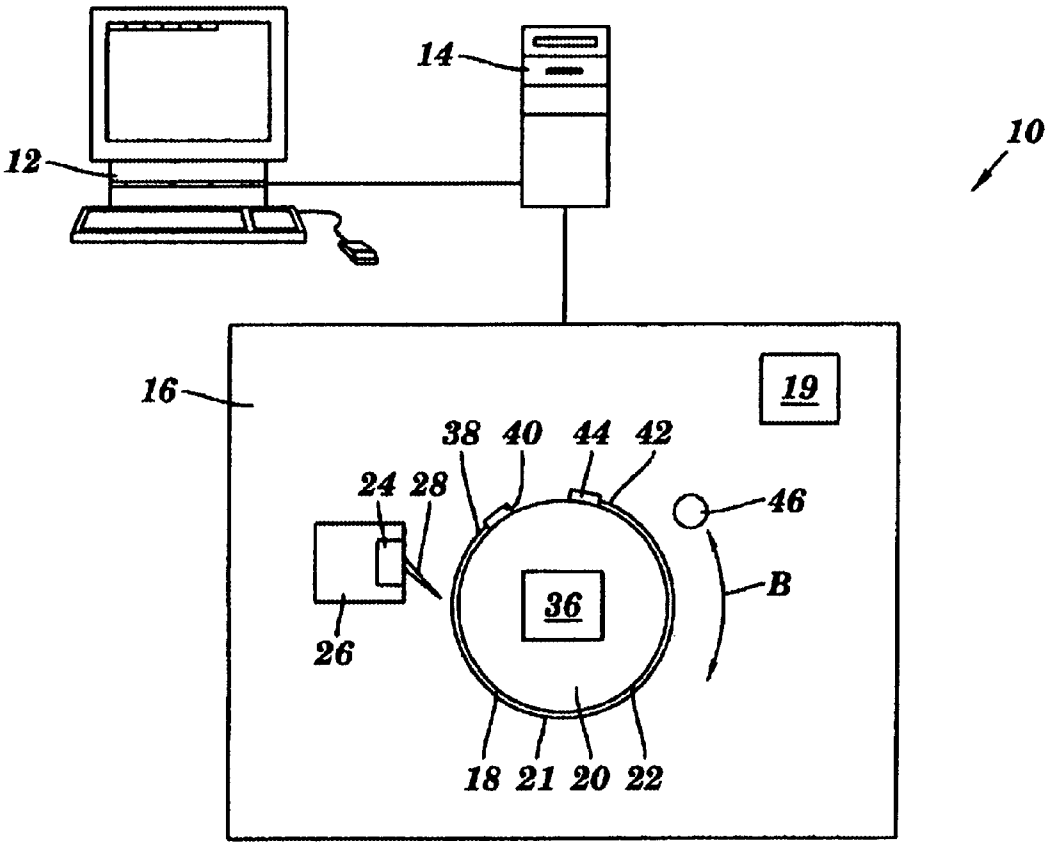
FIG. 1 PRIOR ART
FIG. 1 illustrates an external drum imaging system for recording images onto a supply of recording media such as a printing plate.

An example of an imaging system 10 employing an external drum image recording system is illustrated in FIG. 1. In this example, the imaging system 10 comprises an external drum platesetter configured to record digital data onto a printing plate. Although described below with regard to an external drum platesetter, many aspects of the present invention may be used in conjunction with a wide variety of other types of external drum, internal drum, or flatbed imaging systems, including image setters and the like, without departing from the intended scope of the present invention.

The imaging system 10 generally includes a front end computer or workstation 12 for the design, layout, editing, and/or processing of digital files representing pages to be printed, a raster image processor (RIP) 14 for further processing the digital pages to provide rasterized page data (e.g., rasterized digital files) for driving an image recorder, and an image recorder, such as an external drum platesetter 16, for recording the rasterized digital files onto a printing plate or other recording media. The external drum platesetter 16 records the digital data (i.e., "job") provided by the RIP 14 onto a photosensitive, radiation sensitive, thermally sensitive, or other type of suitable printing plate 18. The printing plate 18 can be manually loaded onto a staging area of the external drum platesetter 16 by an operator. Alternately, or in addition to manual loading, the printing plate may be provided and loaded onto the external drum platesetter 16 by a media supply or autoloading system 19. The media supply system 19 may accept a plurality of the same size printing plates 18, and/or may accept a plurality of different size printing plates 18.

The external drum platesetter 16 includes an external drum 20 having a cylindrical media support surface 22 for supporting the printing plate 18 during imaging. The external drum platesetter 16 further includes a scanning system 24, coupled to a movable carriage 26, for recording digital data onto the imaging surface 21 of the printing plate 18 using a single or multiple imaging beams 28. An example of a scanning system 24 is illustrated in FIG. 2.

In particular, a scanning system 24 is displaced by the movable carriage 26 in a slow scan axial direction (directional arrow A) along the length of the rotating external drum 20 to expose the printing plate 18 in a line-wise manner when a single beam is used or in a section-wise manner for multiple beams. Other types of imaging systems may also be used in the present invention.

The external drum 20 is rotated by a drive system 36 in a clockwise or counterclockwise direction as indicated by directional arrow B in FIG. 1. Typically, the drive system 36 rotates the external drum 20 at a rate of about 100–1000 rpm. The printing plate 18 is loaded onto the external drum 20 while rotating the drum in a first direction. The printing plate 18 is then imaged while the drum is rotated in the first, or in a second, opposite direction. The printing plate 18 is then unloaded from the external drum 20 while rotating the drum in the second direction.

Figure 2:
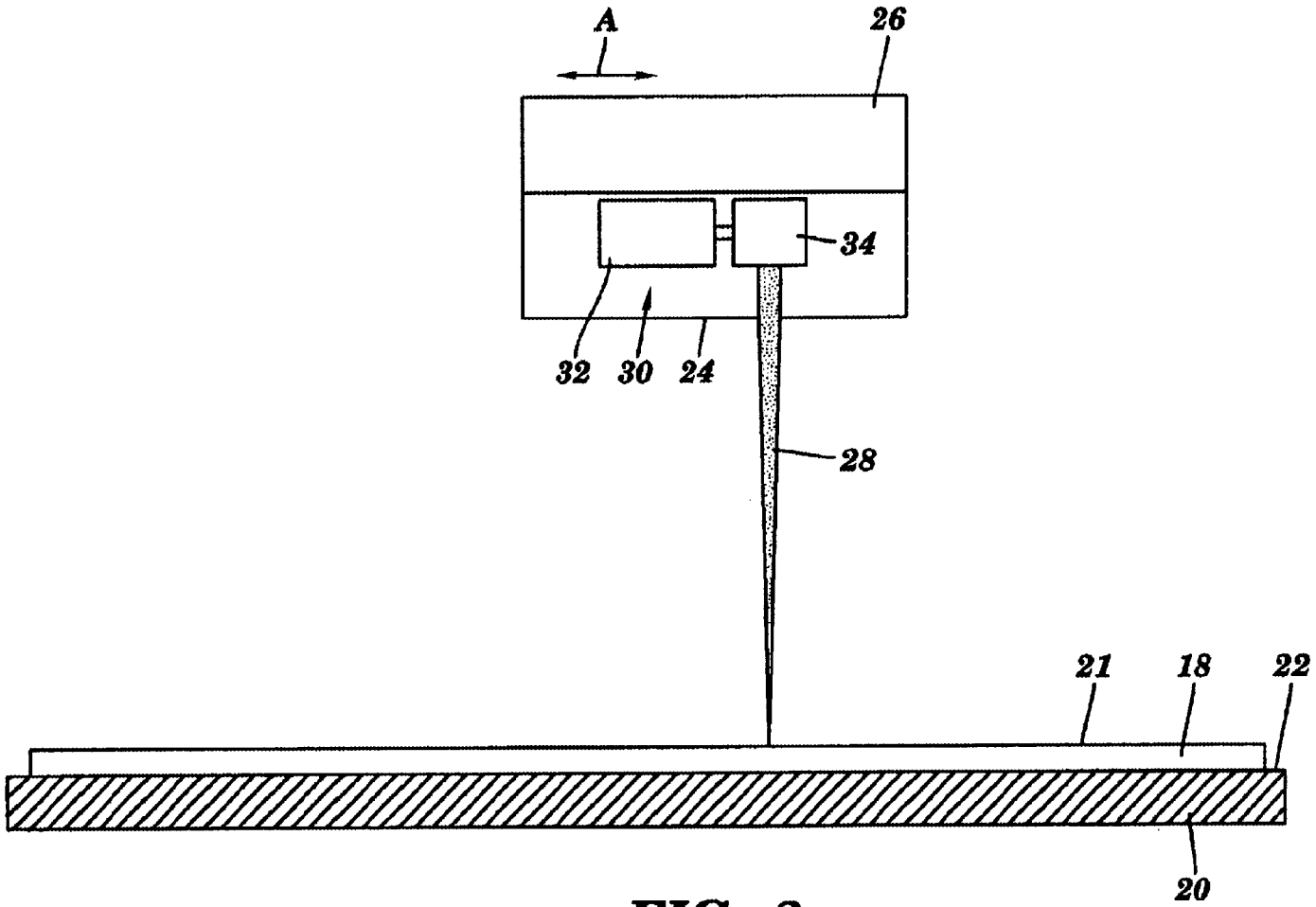
FIG. 2 PRIOR ART
FIG. 2 illustrates an example of an imaging system including a movable optical carriage and scanning system, usable in the external drum imaging system of FIG. 1.

As further illustrated in FIG. 2, the scanning system 24 typically includes a system 30 for generating the imaging beam or beams 28. The system 30 comprises a light or radiation source 32 for producing the imaging beam or beams 28 (illustrated for simplicity as a single beam), and an optical system 34 positioned between the radiation source 32 and the media support surface 22 for focusing the imaging beam or beams 28 onto the printing plate 18. It should be noted, however, that the system 30 described above is only one of many possible different types of scanning systems that may be used to record image data on the printing plate 18. In a particular embodiment, the system 30 comprises a multiple address grating light valve (GLV) or functionally similar modulator based system, or a multiple beam fiber optic coupled laser system.

In the external drum imaging system 10 shown in FIG. 1, the leading edge 38 of the printing plate 18 is held in position against the media support surface 22 by a leading edge clamping mechanism 40. Similarly, the trailing edge 42 of the printing plate 18 is held in position against the media support surface 22 by a trailing edge clamping mechanism 44. Both the trailing edge clamping mechanism 44 and the leading edge clamping mechanism 40 provide a tangential friction force between the printing plate 18 and the external drum 20 sufficient to resist the tendency of the edges of the printing plate 18 to pull out of the clamping mechanisms 40, 44, at a high drum rotational speed. In accordance with one embodiment of the present invention, only a small section (e.g., 6 mm) of the leading and trailing edges 38, 42, is held against the external drum 20 by the leading and trailing edge clamping mechanisms 40, 44, thereby increasing the available imaging area of the printing plate 18.

A stationary ironing roller system 46 flattens the printing plate 18 against the media support surface 22 of the external drum 20 as the external drum 20 rotates past the ironing roller 46 during the loading of the printing plate 18. Alternately, or in addition, a vacuum source may be used to draw a vacuum through an arrangement of ports and vacuum grooves formed in the media support surface 22 to hold the printing plate 18 against the media support surface 22. A registration system, comprising, for example, a set of registration pins or stops on the external drum 20, and a plate edge detection system, may be used to accurately and repeatably position and locate the printing plate 18 on the external drum 20. The plate edge detection system, as described infra, may comprise, for example, a plurality of sensors and/or the scanning system 24.

Figure 3:
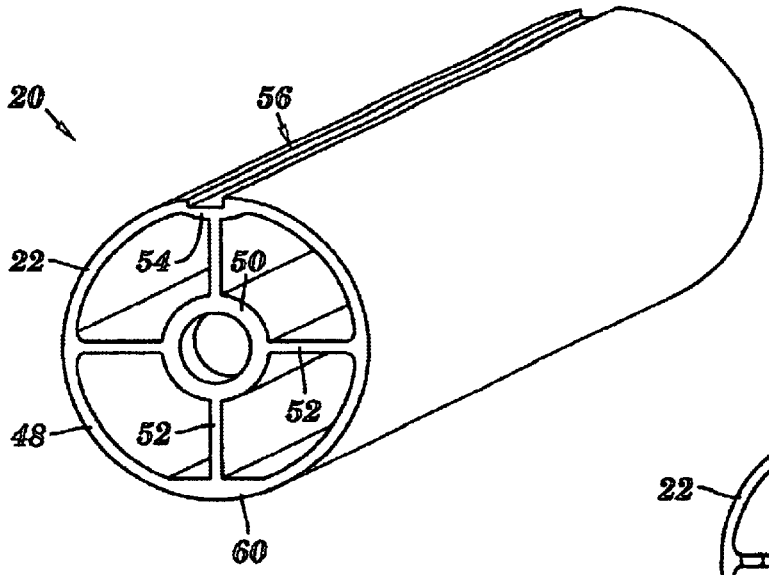
FIG. 3 PRIOR ART
FIG. 3 is a perspective view of the external drum of the imaging system of FIG. 1, in accordance with an embodiment of the present invention.
Figure 4:
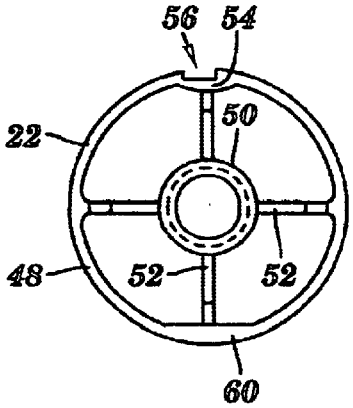
FIG. 4 PRIOR ART
FIG. 4 is an end view of the external drum of FIG. 3.
Figure 5:
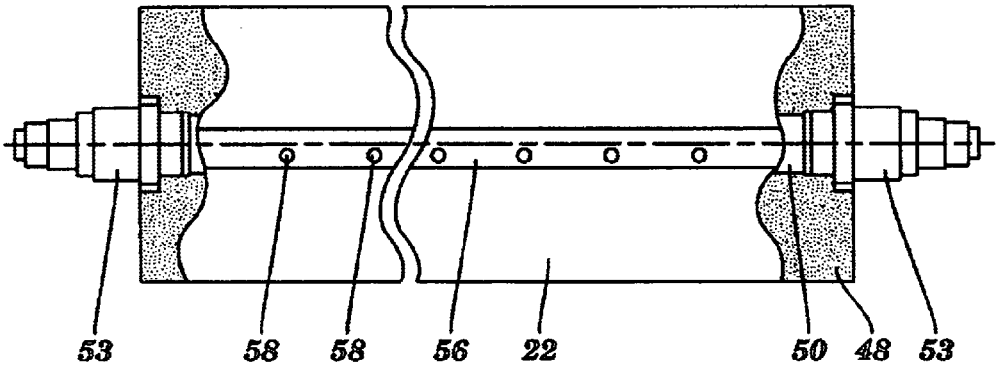
FIG. 5 PRIOR ART
FIG. 5 is a plan view of the external drum of FIG. 3.

A perspective view of the external drum 20 in accordance with one embodiment of the present invention is illustrated in FIG. 3. An end view and a plan view of the external drum 20 are illustrated in FIGS. 4 and 5, respectively. As shown, the external drum 20 includes an outer wall 48 that includes the media support surface 22, a hollow cylindrical hub 50, and a plurality of radial spokes 52 extending between the cylindrical hub 50 and the outer wall 48. The external drum 20 is rotated by the drive system 36 (FIG. 1) via shafts 53 coupled to the ends of the hub 50.

The external drum 20 can be formed in a single piece using an extrusion process from a lightweight and strong material such as an aluminum alloy. Suitable aluminum alloys may include, for example, aluminum alloy 6063-T5. Other aluminum alloys, or alloys formed of metals other than aluminum, that can be suitably extruded, may also be used to form the external drum 20. In other embodiments of the present invention, however, the external drum 20 may be formed of a material such as steel or other ferromagnetic alloy using other processes. Such a material may be required if the leading edge clamping mechanism 40 and/or trailing edge clamping mechanism 44 utilize magnetic or electromagnetic clamping components.

One embodiment of the present invention provides a stiff external drum 20 having low rotational inertia. This allows the external drum 20 to be accelerated and decelerated more rapidly than other currently available drums, using smaller and less expensive motors, power supplies, etc., thereby further increasing the throughput of the imaging system 10 of the present invention.

The outer wall 48 of the external drum 20 further includes a section 54 containing a groove 56 that provides an interface for the leading edge clamping mechanism 40. The leading edge clamping mechanism 40 is attached within the groove 56 by inserting and securing suitable mounting hardware (e.g., bolts, etc.) through the leading edge clamping mechanism 40 and corresponding apertures 58 formed in the bottom of the groove 56. In a particular embodiment of the present invention, the groove 56 is disposed above one of the radial spokes 52. The relative thickness of the outer wall 48 is increased below the groove 56 to maintain minimum wall thickness requirements, and to offset any change in drum balance as a result of removing material to form the groove 56. By forming the groove 56 in this location, the stiffness and strength of the external drum 20 are not compromised. The groove 56 may be formed as part of the extrusion process, and/or may be machined into the external drum 20 after extrusion.

To compensate for the weight of leading edge clamping mechanism 40, and other adjacent system components, thereby balancing the external drum 20 during rotation, the section 60 of the external drum 20 opposite the groove 56 is provided with extra material (i.e., extra mass). This is achieved by increasing the extruded thickness of the outer wall 48 opposite the groove 56. Thus, one aspect of the present invention nominally and inexpensively balances the external drum 20 and leading edge clamping mechanism 40 by adding extruded material opposite the clamping mechanism. Proper balancing of the external drum 20 helps to prevent the introduction of vibration-induced artifacts into the images recorded on the printing plate 18 by the imaging system 10.

Figure 6:
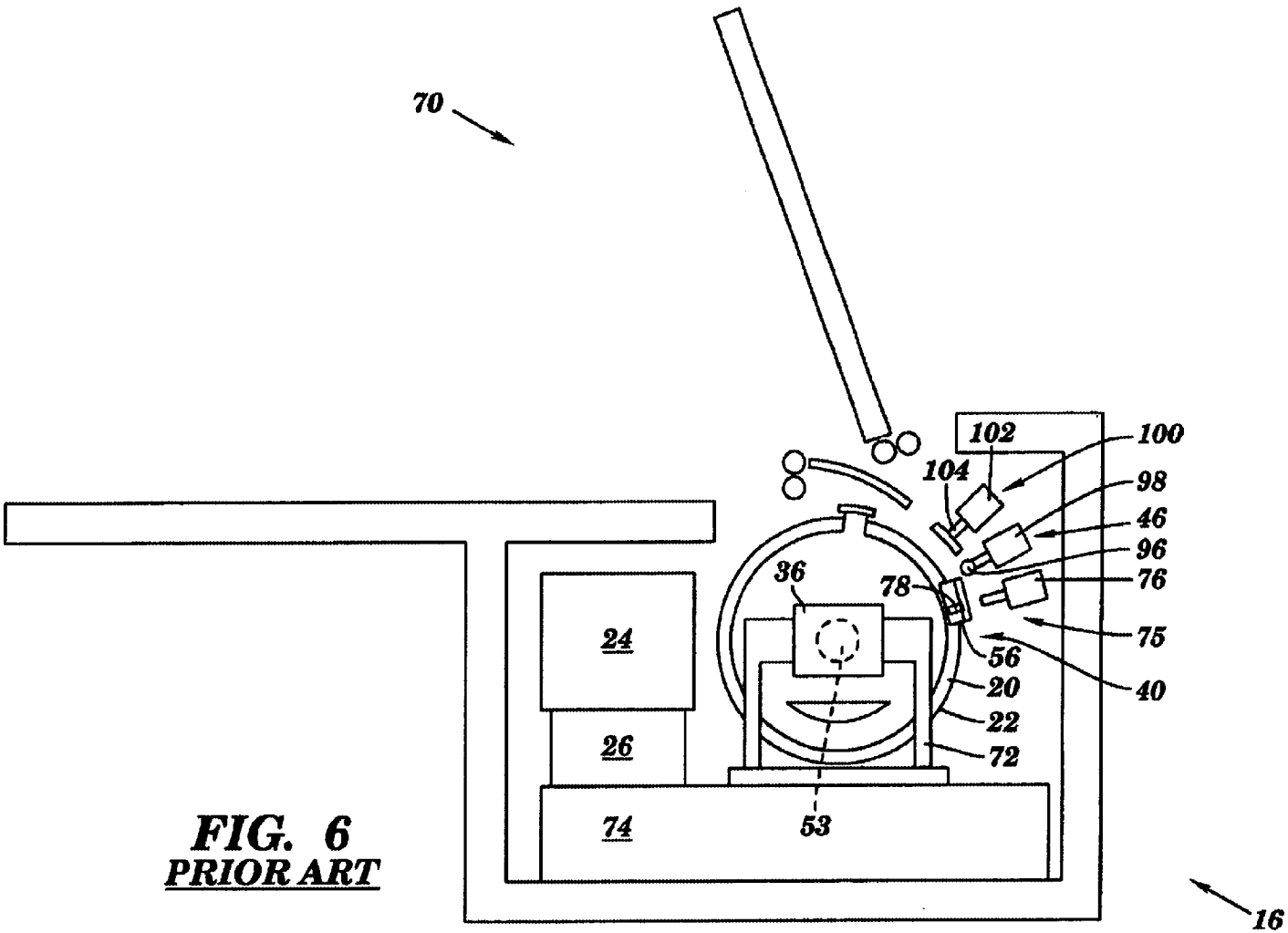
FIG. 6 PRIOR ART
FIG. 6 illustrates the media handling system of an external drum platesetter in accordance with aspects of the present invention.

The basic structure of the media handling system 70 of an external drum platesetter 16 in accordance with a previously proposed embodiment is illustrated in FIG. 6. Many of the features of the imaging system are implemented in accordance with embodiments of the present invention. The external drum platesetter 16 includes an external drum 20 (see, e.g., FIGS. 3–5) having a cylindrical media support surface 22 for supporting a printing plate 18 during imaging. The external drum 20 is supported by a frame 72. A drive system 36 rotates the external drum 20 during imaging. A scanning system 24, carried by a movable carriage 26, travels axially along the rotating external drum 20 to record digital data onto the imaging surface of the printing plate (see, e.g., FIG. 2). The external drum 20 and scanning system 24 are positioned on a base 74. The base 74 is formed of heavy material, such as a polymer-concrete mixture, granite, or the like, to vibrationally isolate the external drum 20 and scanning system 24 from external vibrations, thereby reducing artifacts in the recorded image.

In order to load and hold the printing plate 18 in intimate contact with the cylindrical media support surface 22 of the external drum 20 while the external drum 20 is rotated and an image is recorded onto the printing plate 18, a leading edge clamping mechanism 40 is provided to hold a leading edge 38 of a printing plate 18 in position against the media support surface 22. The clamping system including the leading edge clamping mechanism 40 and the trailing edge clamping mechanism 44, is capable of holding a variety of different printing plate widths either left, right, or center justified on the external drum 20. An actuating system 75, including an actuator 76 (e.g., a pneumatic actuator, solenoid, etc.), selectively opens and closes the leading edge clamping mechanism 40 to receive, capture, and release the leading edge 38 of the printing plate 18. The actuating system 75 of the leading edge clamping mechanism 40 is mounted to a frame member (not shown) of the external drum platesetter 16 such that the actuating system 75 is positioned adjacent the media support surface 22 of the external drum 20.

The leading edge clamping mechanism 40 is fixed in position on the external drum 20. The leading edge clamping mechanism 40 is positioned within a groove 56 (see, e.g., FIGS. 3–5) formed in the external drum 20. A set of registration pins or stops 78 (hereafter referred to as "registration pins") are incorporated into the leading edge clamping mechanism 40 to accurately and repeatably position, or "register," the leading edge 38 of a printing plate 18 at a predetermined location on the external drum 20, and to align the leading edge 38 of the printing plate 18 along an axis which can be substantially parallel to the longitudinal axis of the external drum 20. The registration pins 78 may also be incorporated into an electrical or other mechanical structure for other purposes, such as to electronically or mechanically detect the presence of the leading edge 38 of the printing plate 18 within the leading edge clamping mechanism 40.

Figure 7:
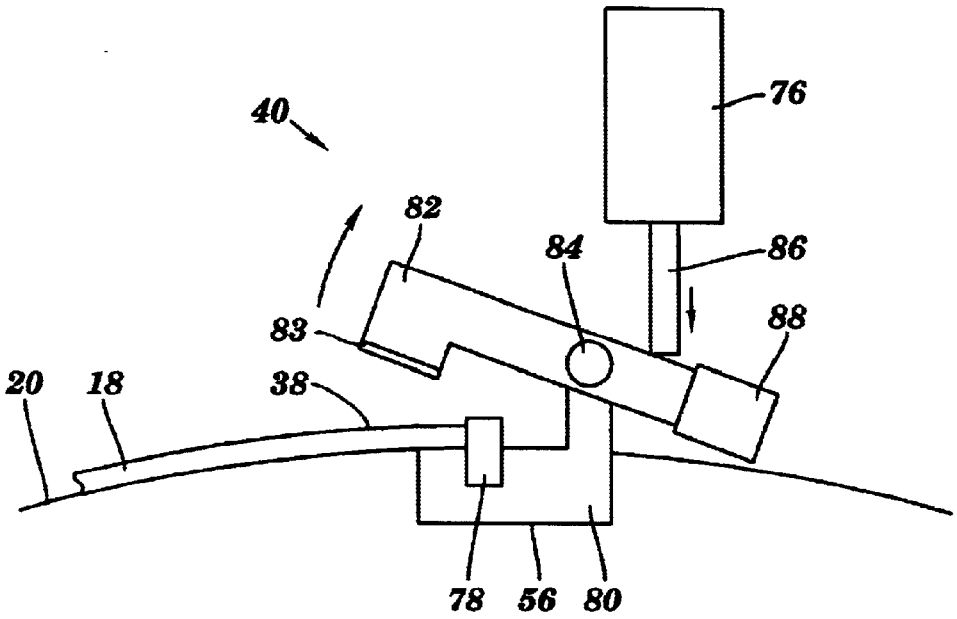
FIG. 7 PRIOR ART
FIG. 7 provides an end view of a leading edge clamping mechanism in an open orientation.
Figure 8:
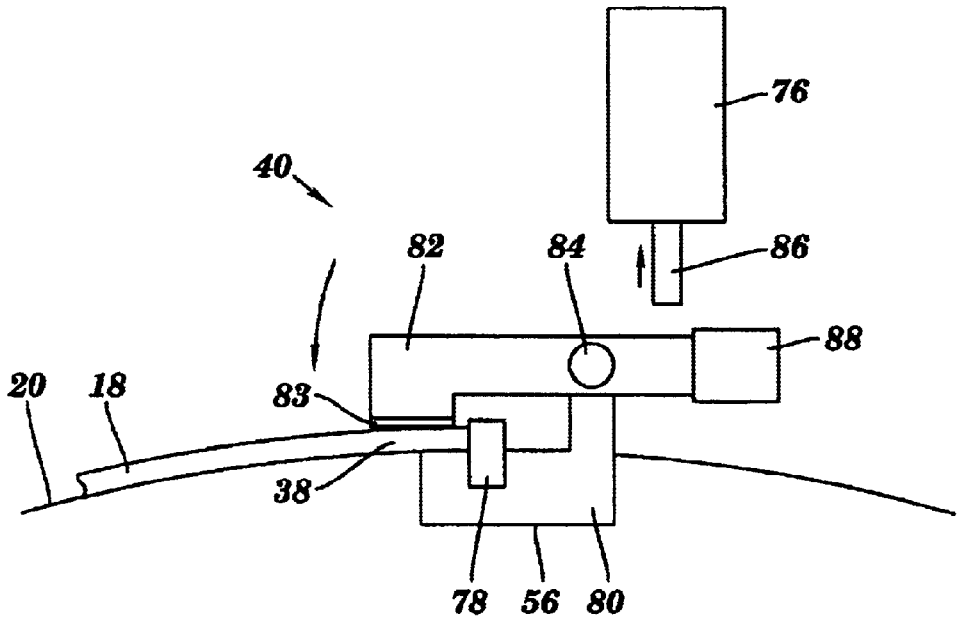
FIG. 8 PRIOR ART
FIG. 8 provides an end view of the leading edge clamping mechanism of FIG. 7 in a closed orientation.

An embodiment of the leading edge clamping mechanism 40 is illustrated in greater detail in FIGS. 7 and 8 which provide end views of the leading edge clamping mechanism 40 in open and closed positions, respectively.

As shown in FIGS. 7 and 8, the leading edge clamping mechanism 40 includes a mounting portion 80 and a clamping portion 82. The mounting portion 80 is used to secure the leading edge clamping mechanism 40 within the groove 56 of the external drum 20. As described with reference to FIG. 5, the leading edge clamping mechanism 40 may be attached within the groove 56 by inserting and securing suitable mounting hardware (e.g., bolts, etc.) through the mounting portion 80 and corresponding apertures 58 formed in the bottom of the groove 56.

The clamping portion 82 of the leading edge clamping mechanism 40 is attached to the mounting portion 80 by a biasing system 84. The biasing system 84, which may comprise a spring system including one or more springs, biases the clamping portion 82 of the leading edge clamping mechanism 40 closed against the mounting portion 80 with sufficient force to prevent the printing plate 18 from moving during rotation of the external drum 20. The actuator 76 is used to selectively open the leading edge clamping mechanism 40 to receive or release the leading edge 38 of the printing plate 18. In particular, as shown in FIG. 7, the actuator 76 includes an extendable member 86 that is configured to selectively engage and press against the clamping portion 82, thereby counteracting the biasing force of the biasing system 84 and opening the leading edge clamping mechanism 40. When the clamping portion 82 of the leading edge clamping mechanism 40 is in an open position as illustrated in FIG. 7, a printing plate 18 may be loaded against the registration pins 78 until two points of the leading edge 38 of the printing plate 18 are in contact with two registration pins 78.

As further illustrated in FIG. 7, during the loading of a printing plate 18 onto the external drum 20, the leading edge 38 of the printing plate 18 is accurately and repeatably positioned and aligned on the external drum 20 using the registration pins 78. Only two axially spaced registration pins 78 contact the leading edge 38 of the printing plate 18 to ensure that the leading edge 38 is correctly positioned along an axis which is substantially parallel to the longitudinal axis of the external drum 20. A plate edge detection system (not shown), comprising, for example, an optical sensor, a mechanical sensor, etc., is used to electronically and/or mechanically sense or detect a perpendicular edge of the printing plate 18 (i.e., an edge perpendicular to the axis of the leading edge 38) to determine the axial position of the printing plate 18 on the external drum 20. Once the exact position of the printing plate 18 is determined on the external drum 20, the scanning system 24 (see, e.g., FIGS. 1, 2, and 6) can be accurately positioned by the movable carriage 26 to record image data in predetermined locations on the printing plate 18 with respect to the leading and perpendicular edges thereof.

As illustrated in FIG. 8, the leading edge 38 of the printing plate 18 is secured in position on the external drum 20 by closing the leading edge clamping mechanism 40. In particular, to close the leading edge clamping mechanism 40, the actuator 76 retracts the member 86 away from the clamping portion 82. This removes the force that previously counteracted the biasing force applied against the clamping portion 82 by the biasing system 84. Accordingly, the clamping portion 82 is now forced toward the external drum 20 by the biasing system 84, thereby securing the leading edge 38 of the printing plate 18 against the external drum 20.

After the leading edge 38 of the printing plate 18 has been properly positioned against the registration pins 78 and secured to the external drum 20 by the leading edge clamping mechanism 40, subsequent media handling operations may then be performed to completely load the printing plate 18 onto the external drum 20. Thereafter, image data may be recorded on the printing plate 18 by the scanning system 24 as the printing plate 18 is rotated on the external drum 20. Upon completion of the imaging process, the printing plate 18 is unloaded from the external drum 20. A layer of rubber or other non-abrasive material 83 may be applied to the clamping portion 82 to prevent damage to the imaging surface of the printing plate 18, to take-up the tolerances of the location of the clamping surface of the clamping portion 82, and to increase friction between the clamping portion 82 and the printing plate 18.

A distal end 88 of the clamping portion 82 of the leading edge clamping mechanism 40 is weighted such that the center of gravity of the clamping portion 82 is located between the biasing system 84 and the distal end 88. In FIGS. 7 and 8, for example, the center of gravity is to the "right" of the biasing system 84. By forming the clamping portion 82 in this manner, the clamping force applied by the clamping portion 82 against the external drum 20 and printing plate 18 increases as the rotational speed of the external drum 20 increases. This helps to prevent the clamping portion 82 from inadvertently releasing the leading edge 38 of the printing plate 18 during high speed rotation (e.g., 1000 rpm) of the external drum 20 during imaging.

Referring again to FIG. 6, a stationary ironing roller system 46 is used to flatten or press the printing plate 18 against the media support surface 22 of the external drum 20 as the external drum 20 rotates past the ironing roller system 46 during the loading of the printing plate 18. In particular, the stationary ironing roller system 46 applies a force that keeps the printing plate 18 in contact against the media support surface 22 of the external drum 20 as the external drum 20 is rotated and the printing plate 18 is applied. The stationary ironing roller system 46 comprises an ironing roller assembly 96, including one or more rollers, and an actuating system 98 for extending or retracting the ironing roller assembly 96 toward or away from the media support surface 22 of the external drum 20. The ironing roller assembly 96 is retracted away from the external drum 20 prior to the imaging of the printing plate 18. The stationary ironing roller system 46 is mounted to a frame member (not shown) of the external drum platesetter 16 such that the stationary ironing roller system 46 is positioned above the media support surface 22 of the external drum 20.

A trailing edge clamping mechanism 44 is provided to hold the trailing edge 42 (see, e.g., FIG. 1) of the printing plate 18 in place against the media support surface 22 of the external drum 20 during rotation of the external drum 20 and imaging of the printing plate 18. Operationally, the trailing edge clamping mechanism 44 is held against the external drum 20 with enough force to resist the forces resulting from wrapping the normally flat printing plate 18 around the cylindrical external drum 20 and to counteract the centrifugal forces which act to lift the printing plate 18 and the trailing edge clamping mechanism 44 off the external drum 20 during rotation of the external drum 20. The same functionality is also provided by the leading edge clamping mechanism 40.

If a single length printing plate 18 is to be imaged by the external drum platesetter 16, the trailing edge clamping mechanism 44 may be located at a fixed position on the external drum 20 corresponding to the location of the trailing edge 42 of the single length printing plate 18. The external drum platesetter 16 of the present invention, however, is intended to be used to image printing plates 18 having different lengths. As such, the position of the trailing edge clamping mechanism 44 is configured to be movable around the outer diameter of the external drum 20 with respect to the leading edge clamping mechanism 40 to accommodate different plate lengths.

In one embodiment, the trailing edge clamping mechanism 44 employs a vacuum to hold the trailing edge 42 of the printing plate 18 against the external drum 20. Other configurations that utilize a magnetic force as described infra, an electro-magnetic force, a mechanical force, etc., to hold the trailing edge 42 of the printing plate 18 against the external drum 20, may also be used. In this embodiment, an actuation system 100 includes an actuator 102 and an extendable arm 104 used to actuate the trailing edge clamping mechanism.

In accordance with one aspect of the present invention, a single actuation system is used to actuate the leading edge clamping mechanism 40 and the trailing edge clamping mechanism 44, as is illustrated in FIGS. 9–16. In this particular embodiment, actuation system 106 includes an actuator 108, which is fixed relative to the rotating drum 20 by fixed member 109, connected by at least one shaft 110 to a movable assembly 112. Movable assembly 112 includes, in this particular embodiment, a pushing member 114 used to actuate the leading edge clamping mechanism 40 and a device for placing and retrieving one or more magnetic clamps 116 of the trailing edge clamping mechanism 44. Actuator 108 can include any suitable drive mechanism such as a pneumatic actuator, solenoid, etc. to move, via one or more shafts 110, the movable assembly 112.

Figure 9:
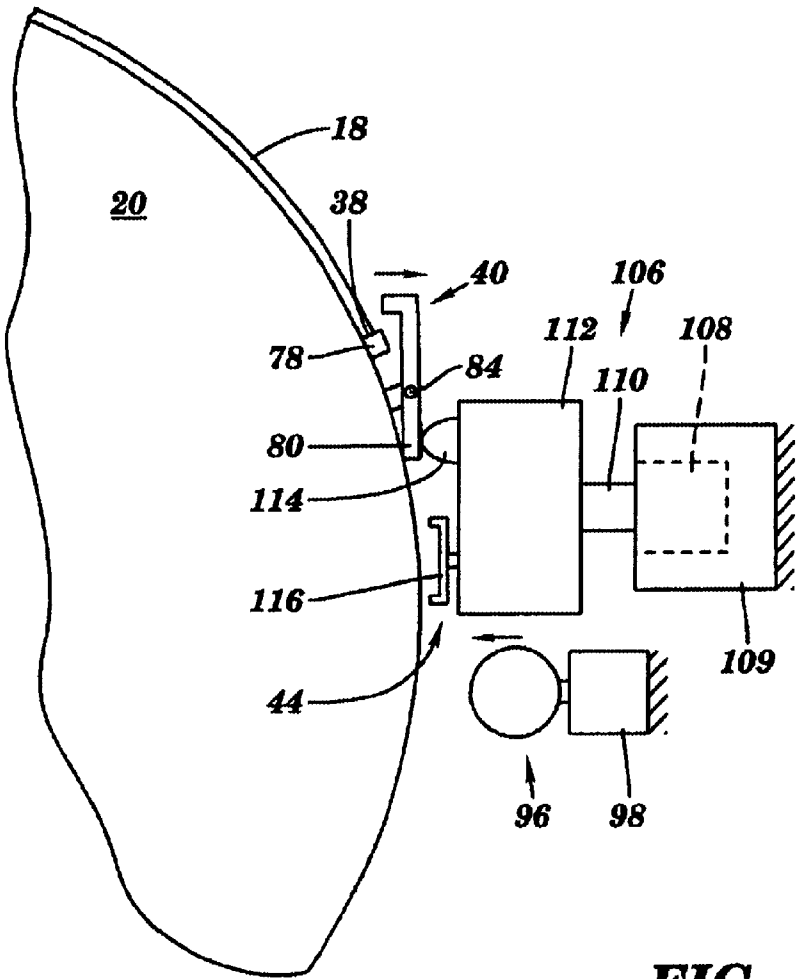
FIGS. 9–11 provide partial end views of an actuation mechanism actuating both the leading and trailing edge clamping edge mechanism in accordance with an embodiment of the present invention.
Figure 10:
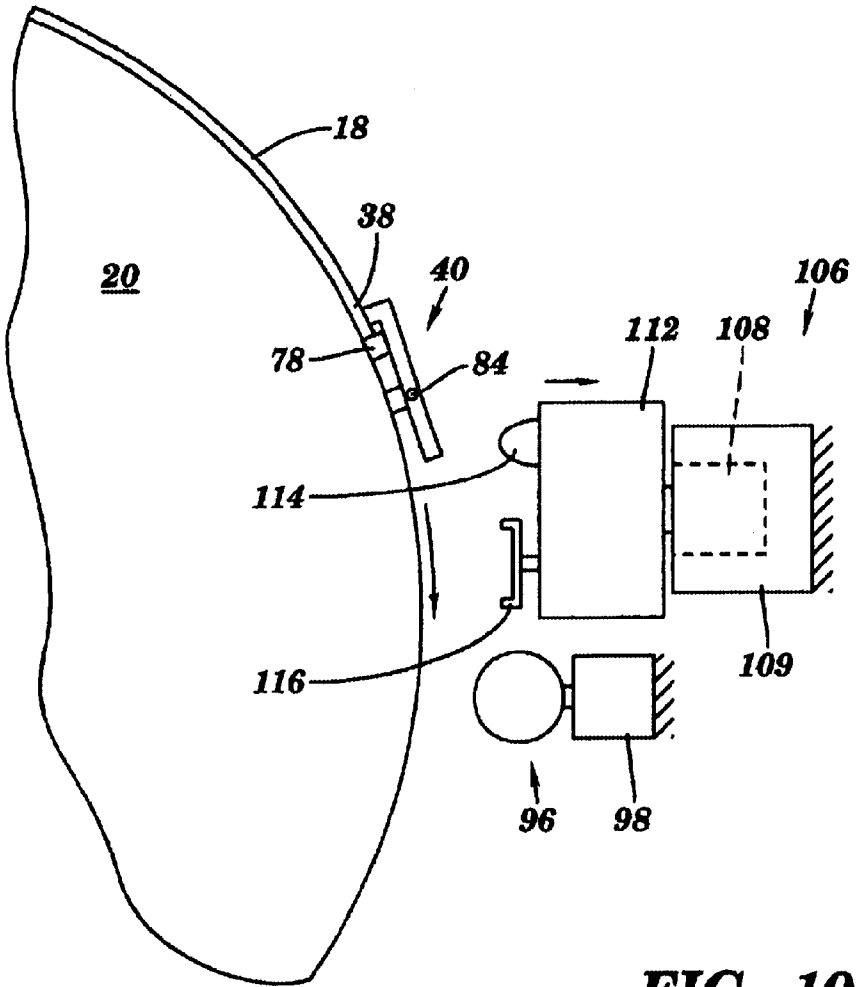
Figure 11:
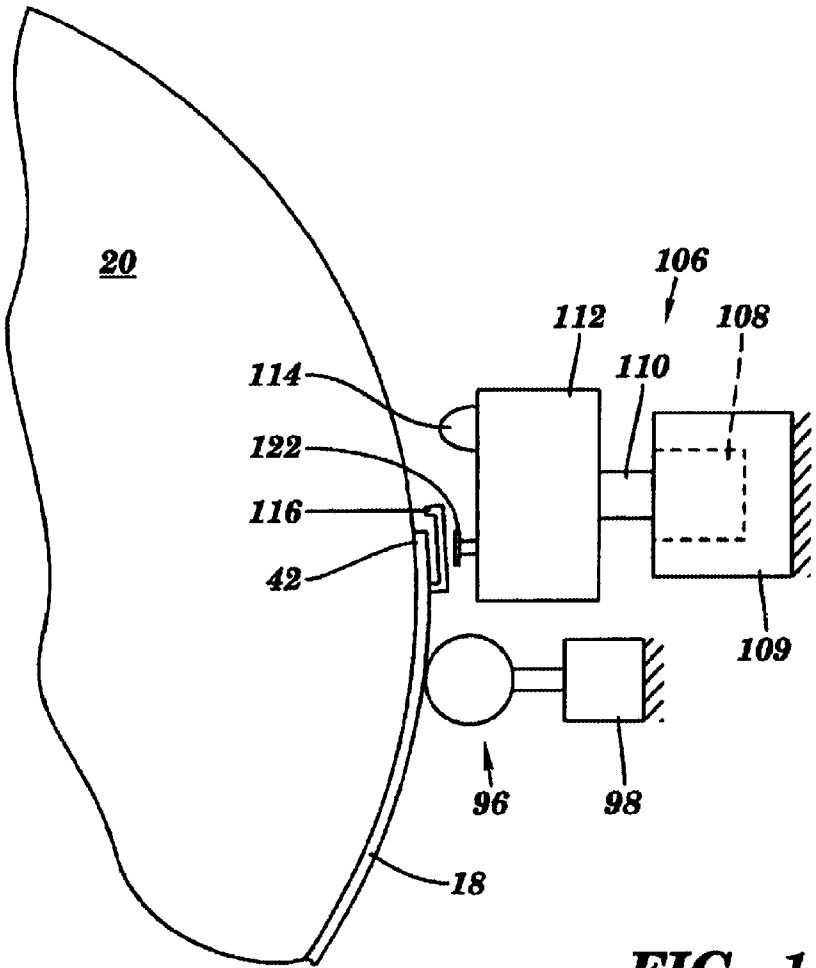
Figure 12:
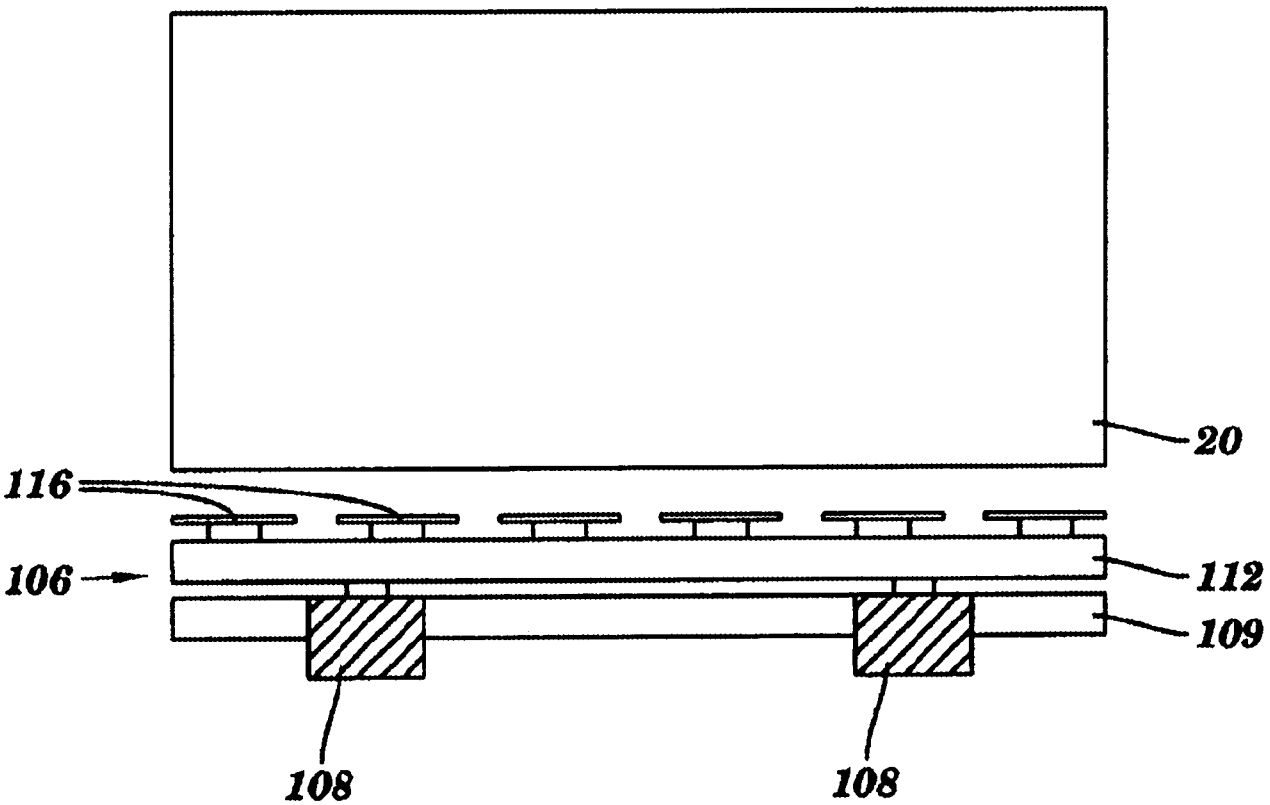
FIG. 12 provides a partial plan view of the embodiment shown in FIGS. 9–11.
Figure 13:
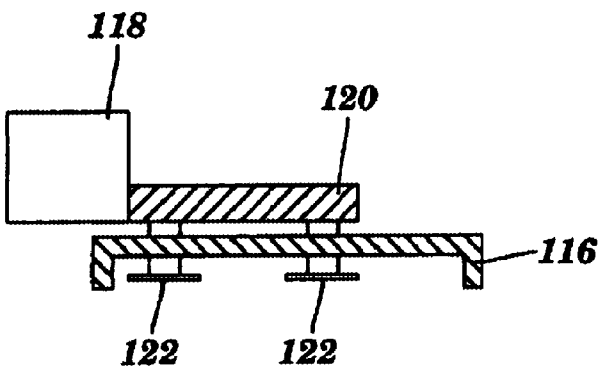
FIGS. 13 and 15 provide partial plan views of an actuation system for actuating a trailing edge clamping mechanism.
Figure 14:
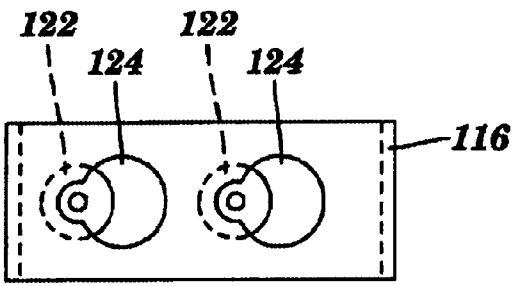
FIGS. 14 and 16 provide partial respective side views of the system in FIG. 13.
Figure 15:
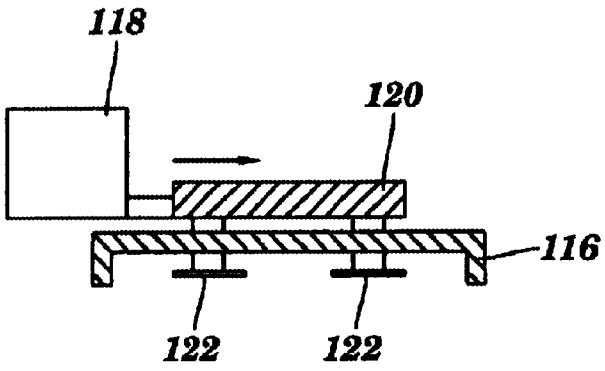
Figure 16:
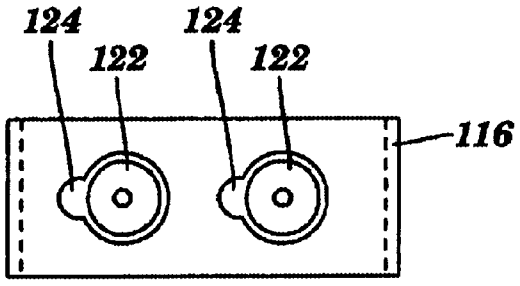

FIG. 9 illustrates the pushing member 114 opening the leading edge clamping mechanism 40 such that the leading edge 38 of the printing plate 18 can be secured to the drum 20. After the leading edge 38 is secured to the drum, actuator 108 retracts movable assembly 112 as shown in FIG. 10 and the drum 20 is rotated in a clockwise direction and the ironing roller assembly 96 is extended to press the printing plate 18 to the drum 20 as it is rotated.

The drum 20 is rotated until the trailing edge 42 of the printing plate 20 is positioned between the magnetic clamps 116 and the drum 20 (FIG. 11) whereupon actuator 108 extends the movable assembly 112 toward the drum 20 to place the clamps 116 adjacent the trailing edge 42 to secure it to the drum.

In this embodiment, an actuator 118 disposed on the movable assembly 112 moves a slide bar 120, which holds the clamps 116, in a direction parallel to the longitudinal axis of the movable assembly 116. This moves slide bar 120 so as to engage or disengage extending members 122 from the magnetic clamps 116 as shown in FIGS. 13–16. That is, the magnetic clamps 116 have apertures 124 therethrough which cooperate with extending members 122 to engage (FIGS. 13 and 14) or disengage (FIGS. 15 and 16) the clamps to the slide bar 120.

In alternative embodiments, the actuation system can be used to perform the functions of actuating the leading and trailing edge clamping mechanisms and the ironing roller assembly.

While this embodiment has been particularly shown and described with references to preferred embodiments thereof, it will be understood by those skilled in the art that various changes in form and details may be made therein without departing from the scope of the invention encompassed by the appended claims.

What is claimed is:

1. A method of securing or unsecuring a printing plate to or from a media support surface comprising:

actuating, with an actuation system, a leading edge clamping mechanism to secure or unsecure a leading edge of the printing plate to the media support surface; and actuating, with the same actuation system, a trailing edge clamping mechanism to secure a trailing edge of the printing plate to the media support surface, including moving a slide bar substantially parallel to a longitudinal axis of the actuation system to engage and disengage extending members, which extend from the slide bar, from one or more magnetic clamps of the trailing edge clamping mechanism that are used to secure the trailing edge of the printing plate to the media support surface.

2. The method of claim 1, wherein actuating the leading edge clamping mechanism is caused by pushing, with the actuation system, a portion of the clamping mechanism such that the leading edge is able to be placed under at least part of the clamping mechanism to secure the leading edge to the media support surface.

3. The method of claim 1, further comprising retrieving, with the actuation system, the one or more magnetic clamps from the media support surface.

4. The method of claim 3, further comprising pressing on the leading edge clamping mechanism to release the leading edge from the leading edge clamping mechanism.

5. The method of claim 1, further comprising advancing an ironing system to press the printing plate against the media support surface after actuating the leading edge clamping mechanism.

6. The method of claim 1, further comprising registering the leading edge of the printing plate to registration pins of the leading edge clamping mechanism.

7. The method of claim 1, further comprising recording an image onto the printing plate.

8. An imaging system comprising:

a media support surface for supporting a printing plate during recording of an image thereon;

a leading edge clamping mechanism for securing a leading edge of the printing plate to the media support surface;

a trailing edge clamping mechanism for securing a trailing edge of the printing plate to the media support surface, including one or more magnetic clamps that are used to secure the trailing edge of the printing plate to the media support surface; and an actuation system for actuating both the leading edge clamping mechanism and the trailing edge clamping mechanism to secure or unsecure the leading or trailing edge of the printing plate, including a slide bar that moves to engage and disengage extending members, which extend from the slide bar, with or from the one or more magnetic clamps.

9. The imaging system of claim 8, further comprising a scanning system for imaging data onto the printing plate during rotation of an external drum that functions as the media support surface.

10. The imaging system of claim 8, wherein the leading edge clamping mechanism includes:

a mounting portion which is attached to a drum cylinder having the media support surface thereon; and a clamping portion, which is pivotally attached to the mounting portion and biased to provide a clamping force to prevent the plate from moving during rotation of the drum cylinder.

11. The imaging system of claim 8, further comprising a stationary ironing roller system for pressing the printing plate to the media support surface as the support surface rotates past the stationary ironing system.

12. The imaging system of claim 11, wherein the stationary ironing roller system includes:

an ironing roller assembly; and an actuating system for selectively extending the ironing roller assembly against the media support surface.

13. The imaging system of claim 8, wherein the printing plate includes aluminum.

14. The imaging system of claim 8, wherein the actuation system includes a pushing member for actuating the leading edge clamping mechanism.

15. The imaging system of claim 8, wherein the actuation system includes an actuator for moving a movable assembly toward and away from the media support surface.

16. An external drum platesetter, comprising:

an external drum cylinder having a cylindrical media support surface for supporting a printing plate during recording of an image thereon;

a leading edge clamping mechanism for holding a leading edge of the printing plate onto the cylindrical media support surface during rotation of the external drum cylinder;

a trailing edge clamping mechanism for holding a trailing edge of the printing plate onto the cylindrical media support surface during rotation of the external drum cylinder, including one or more magnetic clamps that are used to secure the trailing edge of the printing plate to the cylindrical media support surface; and an actuation system used to actuate the leading edge clamping mechanism and the trailing edge clamping mechanism to secure or unsecure the leading or trailing edge of the printing plate, including a slide bar that moves to engage and disengage extending members, which extend from the slide bar, with or from the one or more magnetic clamps.

17. An actuation system for use in an imaging system comprising an actuator for actuating a leading edge clamping mechanism to secure or unsecure a leading edge of a printing plate to a media support surface, the actuator also actuating a trailing edge clamping mechanism to secure a trailing edge of the printing plate to the media support surface, including a slide bar that moves to engage and disengage extending members, which extend from the slide bar, with or from one or more magnetic clamps, of the trailing edge clamping mechanism, that are used to secure the trailing edge of the printing plate to the media support surface.

18. The actuation system of claim 17, wherein the actuation system includes a movable assembly which is used to actuate the leading and trailing edge mechanisms.

19. The actuation system of claim 18, wherein the movable assembly includes a pushing member that opens the leading edge clamping mechanism.

* * * * *